US005594801A

United States Patent [19]

McShane

[11] Patent Number: 5,594,801

[45] Date of Patent: Jan. 14, 1997

[54] AMBIENT EXPANSION LOUDSPEAKER SYSTEM

[76] Inventor: Charles L. McShane, 1910 Seneca La., Mount Prospect, Ill. 60056

[21] Appl. No.: 249,892

[22] Filed: May 26, 1994

[51] Int. Cl.[6] ..... H04R 5/00; H04R 25/00

[52] U.S. Cl. ..... 381/24; 381/1; 381/195

[58] Field of Search ..... 381/1, 24, 88, 381/89, 90, 188, 205, 87, 195, 196

[56] References Cited

U.S. PATENT DOCUMENTS

| | | | |
|---|---|---|---|
| 3,697,692 | 10/1972 | Hafler | 171/1 G |
| 4,489,432 | 12/1984 | Polk | 381/24 |
| 4,497,064 | 1/1985 | Polk | 381/24 |
| 4,586,192 | 4/1986 | Arntson | 381/1 |
| 4,748,669 | 5/1988 | Klayman | 381/1 |
| 4,847,904 | 7/1989 | McShane | 381/24 |
| 5,117,459 | 5/1992 | McShane | 381/24 |
| 5,263,086 | 11/1993 | Yamazaki | 381/1 |

*Primary Examiner*—Forester W. Isen
*Assistant Examiner*—Xu Mei
*Attorney, Agent, or Firm*—Roger J. French

[57] ABSTRACT

A sound reproduction system has audio drivers for producing audio outputs in response to a left channel signal and a right channel signal and for producing an expanded acoustic image. The sound reproduction system comprises a left audio driver for radiating left total audio information corresponding to the left channel signal along a left acoustic axis and a right audio driver for radiating right total audio information corresponding to the right channel signal along a right acoustic axis. An image expansion arrangement is provided for radiating ambience audio information corresponding to predetermined combinations of the left channel signal and the right channel signal along the same left acoustic axis and right acoustic axis as the left total audio information and the right total audio information.

16 Claims, 1 Drawing Sheet

AMBIENT EXPANSION LOUDSPEAKER SYSTEM

BACKGROUND OF THE INVENTION

This invention relates to improvements in sound reproduction and particularly to a novel and improved ambient expansion loudspeaker system for providing improved ambient imaging without regard to the listener position relative to the loudspeaker system.

Generally speaking, loudspeaker systems comprising one or more drivers (sometimes referred to as speakers) are arranged in an enclosure or housing in such a way as to reproduce the full audio frequency spectrum. The individual drivers or speakers may also be arranged so as to radiate the audio spectrum or various portions thereof, in some preselected pattern.

This application utilizes the terms "loudspeaker" or "loudspeaker system" to refer to an apparatus having an enclosure in which one or more drivers are mounted and electrically connected for radiating audio signals. The term "driver" will be used herein to refer to the individual drivers or speakers which may be mounted in such a loudspeaker system. Such drivers commonly include at least one radiating element such as a cone, horn, dome or the like and an electrically driven element or elements such as one or more voice coils or windings to which electrical signals are applied. These voice coils or windings convert the electrical signals into mechanical motion of the cone or other movable sound radiating element to produce corresponding acoustical signals, that is, sound vibrations.

In stereophonic sound recordings or broadcasts, the dimensional content of the signal is generally dependent upon the location and spacing of one or more microphones. For example, if a right channel microphone and a left channel microphone are used in the recording or broadcast, separate left and right loudspeaker systems may be utilized to produce a program with dimensional content similar to the spatial or ambient characteristics in the original location of the recording or broadcast. In this regard, phase and amplitude differences between what is recorded or reproduced in the left channel versus the right channel can cause the ear/brain mechanism to interpret the resulting sound reproduction as having a spatial content or reality. However, for the ear/brain mechanism to be convinced of the spatial effect, it is necessary that the left and right channel sonic information reach the listener's left and right ears independently and in a time sequence consistent with the "ambient signature" of the original recording or broadcast.

The acoustic credibility of loudspeaker reproduction is compromised in many prior art loudspeaker designs by the commingling of left and right channel spatial information in both of the listener's ears. The cranial "shield" between the left and right ears does not adequately isolate or shield the left and right ears from each other such that right channel information will be perceived in the left ear, and vice versa, left channel information will be perceived in the right ear. This interaural mixing of left and right channel information compromises the ear/brain mechanism's full employment of its differential ability to perceive and localize.

In addition to the foregoing, the interaction of the loudspeakers with the listening room creates dimensional compression in the lateral plane which further diminishes the spatial credibility of the listening experience. By "dimensional compression" is meant that acoustic events occurring at right angles to a listener situated in a concert hall are often perceived through loudspeakers as though they were squeezed between the left and right loudspeaker systems. Listeners often attempt to regain some of the dimensional information by spacing the left and right loudspeakers systems as far apart as possible in the listening room. However, when this is done the central image and its specificity are lost, such that the individual performers seem to be split between the left and right loudspeakers.

The two principal elements in lateral localization of sound are time (phase) and intensity. Thus, a louder sound seems closer and sound arriving later in time seems farther away. The listener employs the two ears and the perceptive interval between the two ears to establish lateral location. This involves the so-called Pinnar effect, often discussed in terms of "interaural cross-correlation". In the typical prior art loudspeaker system arrangement, the listener is positioned in front of and equidistant from a pair of loudspeaker systems which are adjusted to radiate approximately equal volumes.

Whatever dimensional quality is gained by the listener is created when the listener is able to compare the acoustic events through the ear/brain mechanism. An imaginary "difference component" is perceived between the left and right loudspeaker in the area between the two loudspeakers, and this difference component diminishes as the listener moves from the equidistant position as a function of the inverse square loss of intensity with proximity. As mentioned above, the independent right ear and left ear perception are also compromised by some left ear perception of the right channel and vice versa. Since the stereophonic or spatial effect of the recorded or broadcast material depends on the listener's perception of the difference between the left and right channels, any reduction in either of the channels due to movement of the listener away from the equidistant position tends to further compromise this situation.

In this regard, some listeners have expressed a preference for stereophonic headphones. Headphones isolate the recorded, time-related ambience by blocking out the impinging ambience of the listening room. They also prevent the arrival of left information at the right ear and vice versa. However, headphones provide limited acoustic performance, principally in the bass region, and are also confining in terms of the listener's freedom of movement, as well as being somewhat uncomfortable to wear for long periods of time. Moreover, the perceived "soundstage" moves with any movement of the wearer's head, rather than remaining spatially fixed, as it ought to for a realistic spatial effect as the listener turns his head.

FIG. 1 illustrates a hypothetical solution to the problem (albeit highly impractical) involving loudspeakers and a wall-barrier which separates the listener's left and right ears in a manner which in effect extends the acoustical "shadow" of the human cranium that separates the left and right ears. This "cranial shadow" alone is effective enough in isolating left and right difference information for wavelengths smaller than the space between left and right ears, for which intensity differences provide localization. However, as wavelengths become longer below roughly 1000 hz, the ear-brain mechanism's sensitivity to phase differences becomes the operative element for providing localization.

These longer wavelength phase differences provide almost all of the dimensional information about the physical size of the original recording hall or room. In two-channel stereo, with the loudspeakers in front of a listener, the interaural commingling referred to is perceived as a narrowing of the frontal "soundstage."

Polk, U.S. Pat. No. 4,489,432 states that an acoustic event occurring at right angles to the primary acoustic event such as the first reflection from the side walls of the concert hall or recording studio, is perceived in conventional prior art loudspeaker systems as though it came from the space between the left and right loudspeakers. Polk further postulates a two-microphone recording where the microphone spacing involved exceeds the cranial separation of the left and right ear.

Some years ago designers learned that a synthesized "difference" component could be extracted from two-channel stereophonic material by simply inverting the relative polarity of the left and right channels so as to obtain either "plus left minus right" (+L-R) or "plus right minus left" (+R-L). In this manner the monophonic component is disabled. Any left or right signal of identical intensity and phase is completely cancelled, leaving only the difference between channels. Conversely, adding the two channels in phase produces Left plus Right (L+R) or pure monophony since any difference signal is combined as a single component.

Researchers learned that the extracted differential L-R or R-L could be independently reproduced through its own dedicated transducers to achieve a variety of effects. When isolated, the differential L-R, R-L was found to simulate the reflection and phase characteristics of the recording studio or concert hall occurring chiefly in the later arrival time domain. When combined with the primary left and right early arrival information a very credible acoustic experience of spatiality could be simulated.

In motion picture applications the differential L-R, R-L component was encoded (often with 3–20 millisecond time delay) and then decoded and reproduced in transducers located at the rear and side walls of the theater. In such a complex acoustic situation a "center-channel" L-R monophonic transducer is often employed to provide the necessary on-screen dialogue specificity and synchronization.

Numerous methods of extracting the differential L-R, R-L information exist. The inventor herein is also the inventor in two prior U.S. Pat. Nos. 4,847,904 and 5,117,459. These patents disclose multiple driver speaker systems employing at least one dual-coil dedicated driver for each of the left and right loudspeaker systems, connected in opposing polarity to produce L-R and R-L differential information. These dedicated differential drivers are mounted adjacent to and angled outwardly from the associated "left" and "right" drivers.

Still another method of extracting differential L-R, R-L information is disclosed in Polk U.S. Pat. Nos. 4,497,064 and 4,489,432; Hafler 3,697,692. The method disclosed in these patents specifies single coil drivers connected from positive Left and Right amplifier terminals.

Polk U.S. Pat. No. 4,489,432 discloses left and right "outboard" loudspeaker systems equipped with left and right subspeakers connected electrically so as to obtain L-R and R-L signals, in addition to L+ and R+ "inboard" drivers. This system solves for the geometric triangulation of sound paths for a listener located equidistant from each left and right speaker system in such a way that the destructive comingling of left and right information in the left and right ears is cancelled. However, the listener must remain equidistant to all times to achieve this effect. In order to create a perceptible time delay between the left and right primary drivers and the L-R and R-L subspeaker drivers, the "inboard" and "outboard" drivers are separated by a finite lateral spacing corresponding to roughly the left-right ear spacing. All of the drivers radiate sound along parallel axes. In this way a precise geometric triangulation situated equidistant between the Left and Right speaker systems. This triangulation is so critical that even small head movements can create image shifts.

Arnston discloses in U.S. Pat. No. 4,586,192 a system that purports to expand the acoustic image by providing an anti-phase signal extracted from the opposite channel. In other words the left speaker receives a right signal in opposite phase, which is fed to a secondary "enhancement" winding of a dual voice coil, and vice versa for the right speaker. This arrangement is such that the right speaker reproduces R-L while the left speaker reproduces L-R. Very significant attenuation of bass frequencies would result were it not for an elaborate filter network which sharply reduces the bass signal in the "enhancement" voice coil winding of each speaker.

OBJECTS AND SUMMARY OF THE INVENTION

Accordingly, it is a general object of this invention to provide a novel and improved ambient expansion loudspeaker system.

A related object is to provide such a loudspeaker system which is relatively simple and inexpensive to construct and yet provides improved ambient imaging without regard to the listener position relative to the loudspeaker system.

In accordance with one aspect of the invention there is provided a sound reproduction system having audio drivers for producing audio outputs in response to a left channel signal and a right channel signal and for producing an expanded acoustic image, said sound reproduction system comprising a left audio driver for radiating left total audio information corresponding to said left channel signal along a left acoustic axis and a right audio driver for radiating right total audio information corresponding to said right channel signal along a right acoustic axis, and image expansion means for radiating ambience audio information corresponding to predetermined combinations of said left channel signal and said right channel signal along the same said left acoustic axis and right acoustic axis as said left total audio information and said right total audio information.

In accordance with another aspect of the invention there is provided a sound reproduction system having at least one audio driver for producing an audio output in response to a left channel signal and a right channel signal, said audio output including an expanded acoustic image, said sound reproduction system comprising an audio driver for radiating audio information along an acoustic axis; said audio driver including a first voice coil for receiving one of said left channel signal and said right channel signal and responsive thereto for causing said audio driver to radiate a corresponding one of left total acoustic information and right total acoustic information along said acoustic axis and a second voice coil for receiving a predetermined combination of said right channel signal and said left channel signal and responsive thereto for causing said audio driver to radiate ambience audio information along said acoustic axis for producing said expanded acoustic image.

In accordance with yet a further aspect of the invention there is provided a method for producing an expanded acoustic image from a left channel signal and a right channel signal, comprising the steps of providing an acoustic driver; coupling said acoustic driver for response to one of said left and right channel signals for radiating a corresponding one of left total acoustic information and right total acoustic information along an acoustic axis, and coupling said acoustic driver in a predetermined fashion to combine said left channel signal and said right channel signal for radiating ambience information along said acoustic axis in addition to said one of said left and right total audio information.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
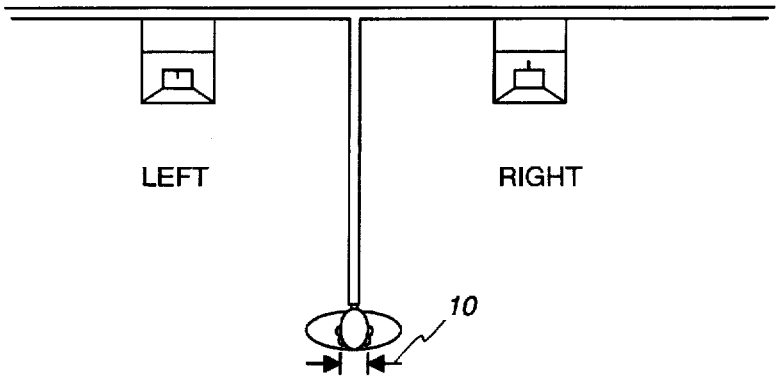
FIG. 1 is a plan view of a hypothetical method of preserving interaural separation in a sound reproduction system.
Figure 2:
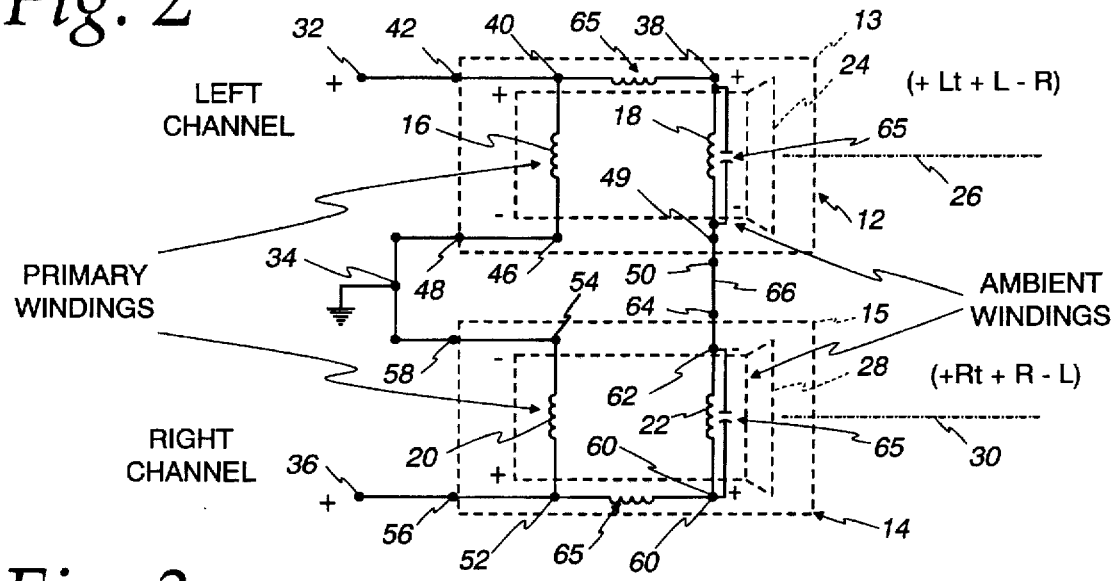
FIG. 2 is a circuit schematic of a sound reproduction system in accordance with one embodiment of the invention.
Figure 3:
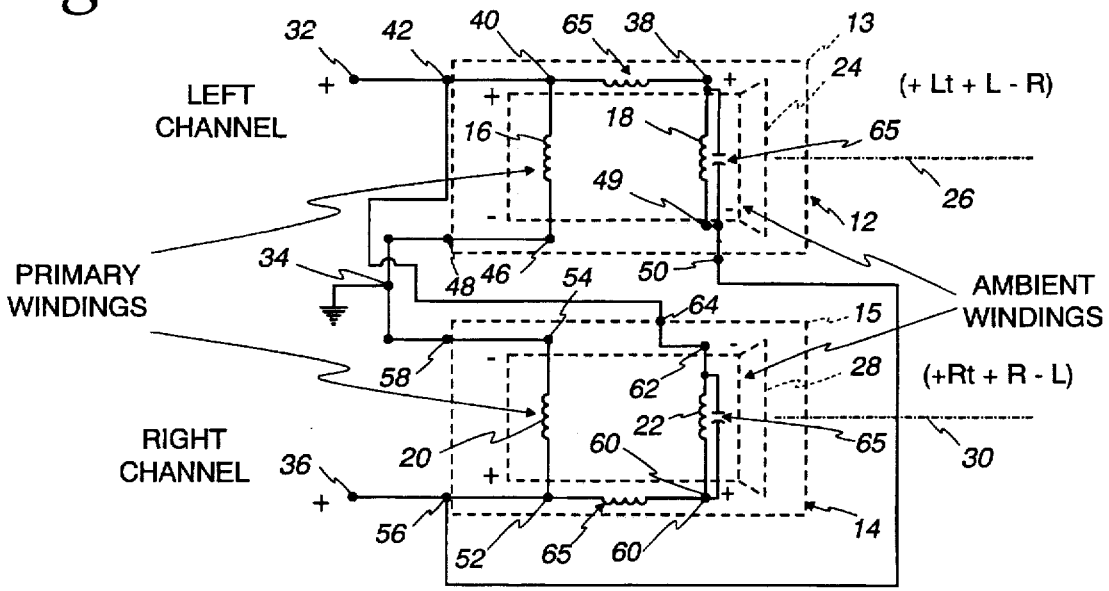
FIG. 3 is a circuit schematic of a sound reproduction system in accordance with a second embodiment of the invention.

Referring now to FIGS. 2 and 3 of the drawings, the present invention provides a simple and cost-effective method of eliminating destructive commingling of left and right information from a pair of spaced apart loudspeaker systems at frequencies below 800 hz, that is, about the wavelength of the interaural space 10 as illustrated in FIG. 1. It will be seen that a left speaker system 12, housed in an enclosure 13, is arranged to provide a left total signal (+Lt) plus an ambient component comprising a left minus right (L-R) signal. Similarly, a right speaker system 14, housed in an enclosure 15, is arranged to provide a right total (+Rt) signal plus an ambient component comprising a right minus left (R-L) signal.

This is accomplished by providing each speaker with a pair of voice coils or windings 16, 18 and 20, 22, respectively, and by connecting respective left and right positive terminals of a common ground design amplifier to positive terminals of each of these voice coils or windings. Two different configurations of connection of the negative or ground terminals of the respective voice coils are possible, namely series connected and parallel connected. FIG. 2 illustrates a series connected system and FIG. 3 illustrates a parallel connected system. Accordingly, the same reference numerals will be utilized in FIGS. 2 and 3 to designate the same elements and components. As will be seen presently, the primary difference between the embodiments of FIGS. 2 and 3 is in the manner of effecting interconnections between various ones of the components thereof.

In accordance with the invention, the sound reproduction system comprises a left audio driver 24 for radiating left total audio information corresponding to a left channel signal along a left acoustic axis 26 and a right audio driver 28 for radiating right total audio information corresponding to a right channel signal along a right acoustic axis 30. In accordance with the invention, means are provided for radiating ambiance audio information along these same left and right acoustic axes 26 and 30.

In order to obtain ambiance audio information along the same acoustic axes as the left total and right total audio information, each of the left and right audio drivers 24 and 28 includes dual voice coils or windings 16, 18 and 20, 22 as indicated above. A first or primary voice coil 16, 20 of the respective drivers is intended to receive the left channel signal and right channel signal, respectively. However, the second or ambient voice coils or windings 18, 22 of the respective drivers 24 and 28 comprise the ambient image expansion means for receiving image expansion signals which comprise predetermined combinations of the right channel signal and the left channel signal. In the illustrated embodiment, the left channel signal is provided across a left channel terminal or output 32 and a common ground terminal 34. Similarly, a right channel signal is provided across a right channel positive terminal or output 36 and the common ground 34. In the embodiments of both FIGS. 2 and 3, the second or ambient voice coils or windings 18, 22 are connected to receive signals which correspond to a difference between the left channel signal and the right channel signal. In particular, the ambient winding 18 of the left driver 24 is connected to receive a signal corresponding to the left channel signal minus the right channel signal, while the ambient winding 22 of the right audio driver 28 is connected to receive a signal corresponding to the right channel minus the left channel signal.

Referring first to the embodiment of FIG. 2, the left minus right difference signal is produced across the ambient winding 18. The winding 18 has a positive terminal 38 which is internally connected (i.e., internally of the enclosure 13 of the speaker system 12) to a positive terminal 40 of the primary winding 16. Both of these terminals 38 and 40 are coupled to an external connection point 42, that is, external to the enclosure 13 (indicated in phantom line). This external connection point 42 is coupled to a positive output 32 of the left channel signal.

The second or negative terminal 46 of the primary voice coil 16 is coupled to an external connection point 48 which is in turn coupled to the common ground 34, thereby coupling the winding or voice coil 16 across the left channel to receive the left channel signal. The opposite or negative terminal 49 of the ambient winding or voice coil 18 is coupled to an external connection point 50.

Referring to the right driver 28, the connections are similar to those described above with reference to the left channel. That is, the primary voice coil or winding 20 has positive and negative terminals 52, 54 which are coupled to respective external connection points 56, 58. These external connection points are coupled across the right channel positive terminal or output 36 and the common ground 34 to deliver the right channel signal to the primary winding or voice coil 20. Thus, the right audio driver 28 will radiate right total audio information corresponding to the right channel signal along the right acoustic axis 30. The ambient voice coil or winding 22 has a positive terminal 60 which is internally connected with the positive terminal 52 of the primary winding 20 and therefore to the positive terminal or output of 36 of the right channel by way of external connection point or element 56. The opposite or negative terminal 62 of the ambient winding 22 is coupled to an external connection point or element 64.

The respective external connections 50 and 64 of the two speaker systems are then joined or connected by a suitable wire or other connecting means 66. This last connection results in the left channel information being present at the negative terminal 62 of the right ambient winding 22 and conversely in right channel information being present at the negative terminal of the left ambient winding 18. The result of these connections is as indicated above, namely, that the left driver 24 receives a left total (+Lt) plus a left minus right (L-R) signal while the right driver 28 receives a right total (+Rt) plus a right minus left (R-L) signal. Importantly, these composite signals are converted to audio information by the drivers 24, 28 along their acoustic axes 26, 30.

Referring now to FIG. 3, the same reference numerals are utilized to indicate the same elements and components. However, it will be noted that the connections utilized to accomplish the same resultant signals at the left and right drivers 24, 28 are somewhat different. Namely, the negative terminals of the respective ambient voice coils or windings 18 and 22 are respectively coupled to the positive terminals of the other of the left and right audio drivers. That is, the negative terminal 62 is coupled to positive terminals 38 and 40, and the negative terminal 48 is coupled to the positive terminals 52 and 60. Preferably, these connections are made at the external connection points of the respective speaker cabinets or enclosures or systems 12, 14. That is, external connection point 64 of speaker system 14 is coupled with external connection point terminal 42 of speaker system 12, while external connection point 50 of speaker system 12 is coupled with external connection point 56 of speaker system 14. The connection shown in both FIG. 2 and FIG. 3 include filter elements 65 to provide an 800 hz 2nd order low-pass filter.

In operation, in the left speaker system 12 for example, the opposite phase right signal functions as an anti-phase mode consistent with the precedence or "Haas" effect. Since the right signal appears on the left speaker in inverted phase or sense, the ear-brain mechanism rejects the later appearance at the left ear of the right signal (from the right speaker system 14) around the cranial shield. In this manner, the left ear rejects the normally occurring right signal and perceives only the left signal. The converse situation occurs on the right side and a listener therefore perceives the left and right signals independently, even when the wavelength exceeds the interaural spacing 10. Thus, the present invention has the effect of enabling listeners with nodal hearing to discern the left signal in the left speaker system while rejecting the later arriving right signal that is normally present, and conversely to discern the right signal in the right speaker system while rejecting later arriving the left signal that is normally present. The effect of two-speaker, two-channel stereophonic sound is thereby maximized by the present invention.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The Invention is claimed as follows:

1. A sound reproduction system having audio drivers for producing audio outputs in response to a left channel signal and a right channel signal and for producing an expanded acoustic image, said sound reproduction system comprising: a left audio driver for radiating left total audio information corresponding to said left channel signal along a left acoustic axis and a right audio driver for radiating right total audio information corresponding to said right channel signal along a right acoustic axis, and image expansion means for radiating ambience audio information corresponding to predetermined combinations of said left channel signal and said right channel signal along the same said left acoustic axis and right acoustic axis as said left total audio information and said right total audio information; wherein said left audio driver includes a first voice coil for receiving said left channel signal and said right audio driver includes a first voice coil for receiving said right channel signal and wherein each of said left and right audio drivers includes a second voice coil comprising said image expansion means for receiving image expansion signals comprising said predetermined combinations of said right channel signal and said left channel signal.

2. A system according to claim 1 wherein said second voice coil of said left audio driver is connected to receive a signal corresponding to said left channel signal minus said right channel signal and wherein said second voice coil of said right audio driver is connected to receive a signal corresponding to said right channel signal minus said left channel signal.

3. A system according to claim 1 wherein each said first voice coil has a first positive terminal and a first negative terminal for connection to receive one of said left channel signal and said right channel signal thereacross, and wherein each said second voice coil has a second positive terminal coupled to said first positive terminal of the corresponding first voice coil and a second negative terminal for connection to receive the one of said left channel signal and said right channel signal other than the one received at the corresponding first voice coil.

4. A system according to claim 3 wherein said left and right audio drivers are housed within respective left and right enclosures and wherein no more than three external connection points to each said audio driver are provided on each said enclosure, said external connection points being coupled respectively to said first positive terminal, to said first negative terminal and to said second negative terminal.

5. A system according to claim 4 wherein the external connection points on each enclosure which are coupled with said second negative terminal are externally coupled to each other.

6. A system according to claim 4 wherein the external connection point on each enclosure which is coupled to the second negative terminal is externally coupled to the external connection of the other enclosure coupled to the first positive terminal.

7. A system according to claim 3 wherein the second negative terminals of said left and right audio drivers are connected to each other.

8. A system according to claim 3 wherein the second negative terminal of each of said left and right audio drivers is connected to the first positive terminal of the other of said left and right audio drivers.

9. A system according to claim 3 wherein said left and right audio drivers are housed in a single enclosure and wherein no more than two external connection points are provided on said enclosure for each audio driver, said external connection points being coupled respectively to the first positive terminal and first negative terminal of each said audio driver, and remaining connections being made internally of said enclosure.

10. A sound reproduction system having at least one audio driver for producing an audio output in response to an audio signal, said audio output including an expanded acoustic image, said sound reproduction system comprising: an audio driver for radiating audio information along an acoustic axis; said audio driver including a first voice coil for receiving a first audio signal corresponding to one of two channels of audio information and responsive thereto for causing said audio driver to radiate corresponding acoustic information along said acoustic axis and a second voice coil for receiving a second audio signal corresponding to a predetermined combination of said two channels of audio information and responsive thereto for causing said audio driver to radiate ambience audio information along the same said acoustic axis for producing said expanded acoustic image.

11. A system according to claim 10 wherein said first voice coil has a first positive terminal and a first negative terminal for connection to receive said first audio signal thereacross, and wherein said second voice coil has a second positive terminal coupled to said first positive terminal and a second negative terminal for connection to receive an audio signal corresponding to the other of said two channels of audio information, such that said second voice coil can receive a signal corresponding to a difference between said two channels of audio information.

12. A system according to claim 10 wherein said audio driver is housed within an enclosure and wherein no more than three connection points to said audio driver are provided externally of said enclosure, said connection points being coupled respectively to said first positive terminal, to said first negative terminal and to said second negative terminal.

13. A method for producing an expanded acoustic image from a left channel signal and a right channel signal, comprising the steps of: providing an acoustic driver; coupling said acoustic driver for response to one of said left and right channel signals for radiating a corresponding one of left total acoustic information and right total acoustic information along an acoustic axis, and coupling said acoustic driver in a predetermined fashion to combine said left channel signal and said right channel signal for radiating ambience information along said acoustic axis in addition to said one of said left and right total audio information; wherein the step of providing said acoustic driver comprising providing an acoustic driver having two voice coils and wherein the step of coupling said acoustic driver comprises coupling one of said voice coils to receive one of said left channel signal and said right channel signal and coupling the other of said voice coils to receive a signal corresponding to a difference between said left channel signal and said right channel signal.

14. A method according to claim 13 and further comprising providing a second acoustic driver having two voice coils, coupling one of the voice coils of said second acoustic driver to receive the other of said left channel signal and said right channel signal and coupling the other of said voice coils of said second acoustic driver to receive a signal corresponding to a difference between the said left channel signal and said right channel signal.

15. A method according to claim 14 wherein the step of coupling comprises coupling said one voice coil of said first acoustic driver to receive said left channel signal, coupling the second voice coil of said first acoustic driver to receive a signal corresponding to the left channel signal minus the right channel signal, coupling said one voice coil of said second acoustic driver to receive said right channel signal and coupling said other voice coil of said second acoustic driver to receive a signal corresponding to said right channel signal minus said left channel signal.

16. An electro-acoustic transducer for producing audio outputs in response to a left channel signal and a right channel signal and for producing an expanded acoustic image, said electro-acoustic transducer comprising: a left audio driver having a left channel input for receiving said left channel signal and responsive thereto for radiating left total audio information corresponding to said left channel signal along a left acoustic axis and a right audio driver having a right channel input for receiving said right channel signal and responsive thereto for radiating right total audio information corresponding to said right channel signal along a right acoustic axis, and each of said left and right audio drivers having an image expansion input and being responsive to predetermined combinations of said left channel signal and said right channel signal received at said image expansion input for radiating ambience audio information corresponding to said predetermined combinations of said left channel signal and said right channel signal along the same said left acoustic axis and right acoustic axis as said left total audio information and said right total audio information.

* * * * *